US007510084B2

(12) United States Patent
Bishop

(10) Patent No.: US 7,510,084 B2
(45) Date of Patent: Mar. 31, 2009

(54) MATERIAL SEPARATION DEVICE AND METHOD

(76) Inventor: Cairn L. Bishop, 407 Liberty St., Warren, PA (US) 16365

( * ) Notice: Subject to any disclaimer, the term of this patent is extended or adjusted under 35 U.S.C. 154(b) by 378 days.

(21) Appl. No.: 11/261,398

(22) Filed: Oct. 28, 2005

(65) Prior Publication Data

US 2007/0095727 A1 May 3, 2007

(51) Int. Cl.
*B07B 1/28* (2006.01)

(52) U.S. Cl. ..... 209/309; 209/313; 209/315

(58) Field of Classification Search ..... 209/308, 209/309

See application file for complete search history.

(56) References Cited

U.S. PATENT DOCUMENTS 1,832,776 A * 11/1931 Hudson ..... 210/94
2,893,563 A * 7/1959 Bottum ..... 210/448
4,413,675 A * 11/1983 Gano ..... 165/119
4,484,852 A 11/1984 Anderson
5,165,440 A * 11/1992 Johnston ..... 137/13
6,214,400 B1 4/2001 Zittel et al.
6,612,258 B2 9/2003 Isman et al.

* cited by examiner

*Primary Examiner*—Patrick H Mackey
*Assistant Examiner*—Terrell H Matthews
(74) *Attorney, Agent, or Firm*—The Webb Law Firm

(57) ABSTRACT

A material separation device for use in an internal area of a material handling system. The separation device includes a separator member with a body with a plurality of material passageways extending therethrough. The separator member includes a material exit portion. The device also includes an attachment mechanism for securely attaching the separator member within the internal area of the material handling system. A method of manufacturing a material separation device is also disclosed.

19 Claims, 2 Drawing Sheets

MATERIAL SEPARATION DEVICE AND METHOD

BACKGROUND OF THE INVENTION

1. Field of the Invention

The present invention relates generally to material handling and transfer systems for use in connection with powdered, granular or small particle materials and, in particular, to a material separation device and method for use in such material handling and transfer systems, such as in systems used to handle and transfer food products, such as flour, sugar, cornmeal, starch, rice and the like or other similar powdered products, such as cement.

2. Description of the Related Art

In order to transfer, handle and process various materials, a material handling system is used and includes a series of vessels, containers, systems and pipelines. For example, in moving the material from one location to another for further processing, the material handling system serves to provide a transit route through which the material flows. In addition, such material handling systems are used to load and unload transportation vehicles, and are often attached to or associated with these vehicles.

When dealing with certain powdered, granular or small particle materials, the material handling system typically includes a vacuum system or the like for pulling the materials from the source vessel or vehicle, through a series of pipes and into the destination vessel or bin. By effecting a vacuum in the transfer pipe, the particles of the material are pulled through the pipes. However, these transfer pipes and systems may include numerous and various fixtures, components, elbows and other objects or walls in the path of the particles of material.

Often, these fixtures, components and elbows, which provide pockets and impact zones, coupled with the pull of the vacuum, cause the small particles of the material to impact and clump together. Such clumping of material could gradually increase until there is significant or total blockages in the pipeline. Similarly, many powdered materials, e.g., flour, sugar, cornmeal, cement, starch, etc., clump together in the source vessel or during transfer if moisture is introduced, or when the material settles in the vessel. Again, these clumps could lodge in the transfer pipes and hamper or prevent an effective transfer process. These clumps or lumps of material should be broken apart or dissipated during the transfer process.

According to the prior art, various methods and devices have been introduced to alleviate this problem. For example, U.S. Pat. No. 4,484,852 introduces a dispensing means 10 with a discharge conduit 14 and a bottom unit 20. The bottom unit includes a plate 60 spanning the hopper opening 32, and this plate is vibrated by a vibration unit, or impulser 120. The vibration of the plate 60, together with the slant of this plate 60, influences the material toward a discharge outlet 26. Furthermore, the plate 60 includes a riffle pattern which, when combined with the vibration, breaks apart any clumps or lumps of material during transfer.

Another device that is used to separate material during transfer is found in U.S. Pat. No. 6,612,258, which is directed to a method and system for manufacturing animal bedding. In this system, a specially designed frame 480, 500 is provided and includes a grated section 540. In operation, flax is moved through the frame 480, 500 and further through the grated section 540. Accordingly, the lighter fibers, which tend to wad or clump together, are pulled through the grated section 540 and separated thereby.

In the specific application of transferring food products, U.S. Pat. No. 6,214,400 describes a method for processing food product. To agitate the food products 32 that have clumped together, a baffle 88 contacts these products 32 in a drum 52. In particular, the baffles 88 orbit the drum 52 as the drum rotates and urges the food products 32 away from the sidewall 54 of the drum 52. The food products 32 slide and tumble along the baffle 88, and food products 32 that have gathered at the bottom of the drum 52 are lifted and mixed with a heat transfer medium. In this manner, clumps of food products 32 are broken up and heat transfer is increased.

There remains considerable room for improvement in the art of separating clumped material during a transfer or similar process. For example, the above-described prior art solutions are not useable within a piping system. Further, none of the prior art devices and systems are retrofittable within an existing pipeline. Instead, these prior art devices and systems disclosed complex mechanical structures that represent a component of a manufactured system. Therefore, there remains a need for a material separation device that overcomes these deficiencies and effectively separates various materials during the transfer, loading or unloading processes.

SUMMARY OF THE INVENTION

It is, therefore, an object of the present invention to provide a material separation device and method that overcomes the deficiencies and drawbacks of the prior art. It is another object of the present invention to provide a material separation device and method that is retrofittable within an existing material handling system, such as an existing transfer pipe. It is a further object of the present invention to provide a material separation device and method that is capable of being implemented and fit with existing equipment. It is a still further object of the present invention to provide a material separation device and method that effectively separates powdered and other "clumpable" products, such as food products, during the transfer, loading and/or unloading process. It is yet another object of the present invention to provide a method of manufacturing a material separation device.

Accordingly, the present invention is directed to a material separation device for use in an internal area of a material handling system. This separation device includes a separator member with a body with a plurality of material passageways extending therethrough. In addition, the separator member includes a material exit portion. The device also includes an attachment mechanism for securely attaching the separator member within the internal area of the material handling system.

The present invention is further directed to a method of manufacturing a material separation device. This method includes the steps of: (a) forming a separator member having a substantially planar body with a plurality of passageways extending therethrough; (b) manipulating the body substantially into the form of a cone or a dome having: (i) a base area with a material exit portion positioned at a bottom edge thereof; and (ii) a tip area; and (c) attaching the base area of the body to an attachment mechanism.

Further, the present invention is directed to a method of separating a material flowing through a material handling system. This method includes the initial step of attaching a separation device between a first, upstream portion of the material handling system and a second, downstream portion of the material handling system. The separation device includes a separator member having: (i) a body with a plurality of material passageways extending therethrough; and (ii) a material exit portion. The body projects within and towards the first, upstream portion of the material handling system. The method further includes the step of contacting the material flowing through the first, upstream portion of the material handling system with the body of the separation device, thereby separating any clumped material flowing through the material handling system. In this manner, the separated material flows through the material exit portion of the body and into the second, downstream portion of the material handling system.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE DRAWINGS

DETAILED DESCRIPTION OF THE PREFERRED EMBODIMENTS

Figure 1:
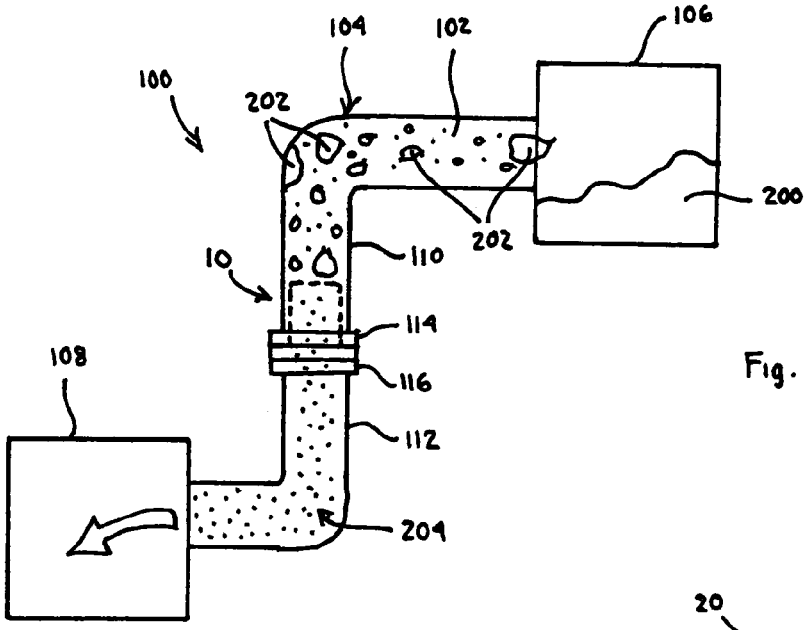
FIG. 1 is a schematic view of one embodiment of the material separation device according to the present invention and used in a material handling system.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

It is to be understood that the invention may assume various alternative variations and step sequences, except where expressly specified to the contrary. It is also to be understood that the specific devices and processes illustrated in the attached drawings, and described in the following specification, are simply exemplary embodiments of the invention.

Figure 6:
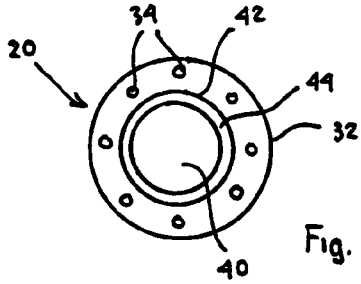
FIG. 6 is a top view of a preferred embodiment of an attachment mechanism of a material separation device according to the present invention.
Figure 7:
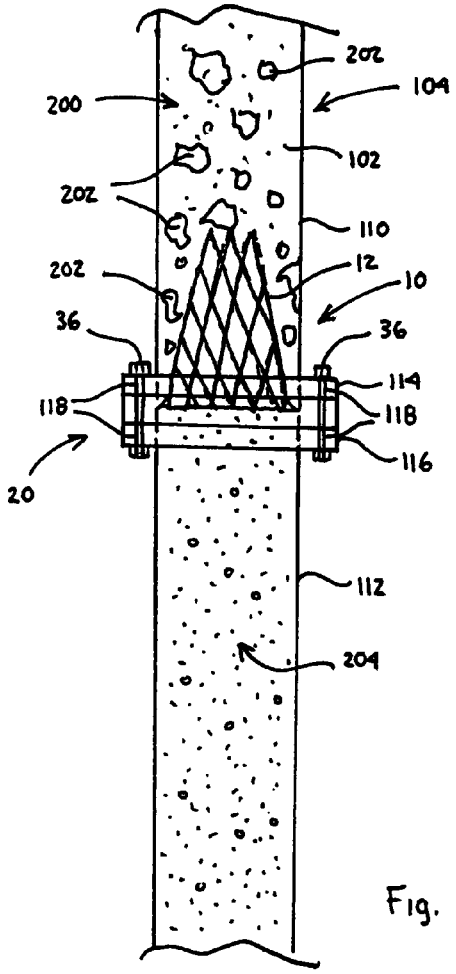
FIG. 7 is a schematic view of one embodiment of a material separation device according to the present invention and connected within an internal area of a transfer pipe.
Figure 11:
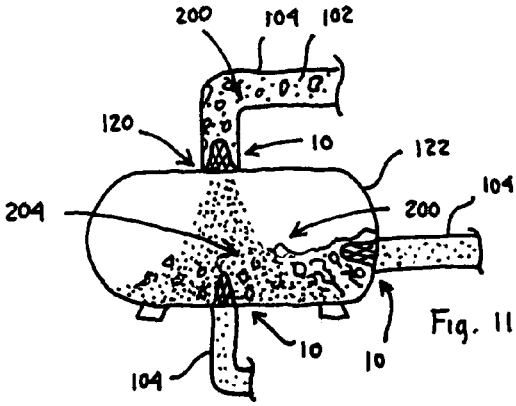
FIG. 11 is a schematic view of a material separation device according to the present invention and used in connection with loading material into and out of a vessel.

The present invention is directed to a material separation device 10, as illustrated in various embodiments in FIGS. 1-10, and in use in connection with a material handling system 100 in FIGS. 1, 7 and 11. In particular, the material separation device 10 is adaptable for use in connection with a material handling system 100 that transfers a material 200 through an internal area 102 of a material transfer pipe 104, or loading the material to and from a collection vessel 122.

For example, as illustrated in schematic form in FIG. 1, the material separation device 10 can be used within the internal area 102 of the material transfer pipe 104 connecting a feed vessel 106, which serves to hold or contain a material 200 prior to transfer. The transferred material 200 is a material that clumps or sticks together, or may clump or stick together, during the transfer, loading or unloading process. An example of such a material 200 is a powdered material, a granular material, a food product, flour, rice, sugar, cornmeal, starch, cement, etc. As discussed hereinafter, the material separation device 10 can also be used with loading and unloading a vessel 122 through attachment directly to a portion of the vessel 122.

In one embodiment, and in order to draw the material 200 from the feed vessel 106, and as is known in the art, a vacuum system 108 effects a vacuum upon the feed vessel 106 through the material transfer pipe 104. In this manner, the material 200 is drawn from the feed vessel 106, through the internal area 102 of the material transfer pipe 104 and towards a further processing unit or vessel, for example, a vehicle, a tank car, a vessel, a storage tank, a further processing step or unit, etc.

As illustrated in FIG. 1, the material separation device 10, when positioned in the internal area 102 of the material transfer pipe 104, acts on clumps 202 of material 200, and separates these clumps 202 into smaller particles 204, such as individual particles of the material 200 or smaller portions or "clumps" that are more easily handled by the material handling system 100.

The material separation device 10 includes a separator member 12. The separator member 12 includes a body 14 having multiple material passageways 16 extending through the body 14. In addition, the separator member 12 includes a material exit portion 18, through which the broken or separated clumps 202 of material 200 (or particles 204) exit into the downstream process.

As shown in FIG. 1, the material separation device 10 can be used between a first, upstream section 110 of the material transfer pipe 104, and a second, downstream section 112 of the material transfer pipe 104. In operation, the material 200 is drawn from the feed vessel 106 and through the first, upstream section 110 of the material transfer pipe 104. Next, the material 200 contacts the separator member 12 of the material separation device 10, which separates these clumps 202 of material 200, thereby allowing the particles 204 of the material 200 to flow through the material exit portion 18 of the body 14 and into the second, downstream section 112 of the material transfer pipe 104. The material separation device 10 also includes an attachment mechanism 20 for securely attaching the separator member 12 (and material separation device 10) within the internal area 102 of the material transfer pipe 104 or, as discussed hereinafter, within an internal area of the material handling system 100, such as the vessel 122.

Figure 2:
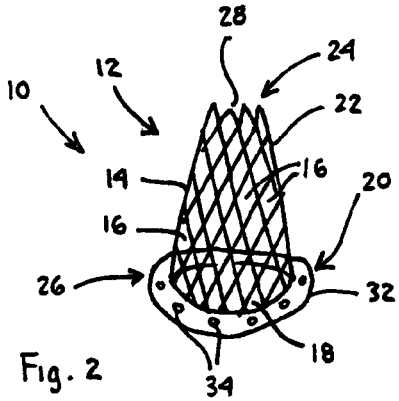
FIG. 2 is a perspective view of one preferred embodiment of a material separation device according to the present invention.
Figure 3:
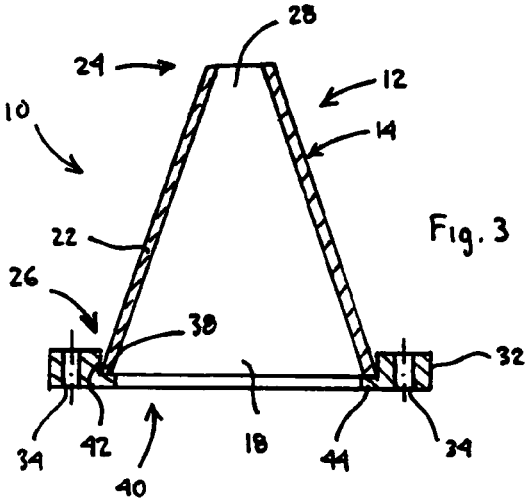
FIG. 3 is a side, sectional view of the material separation device of FIG. 2.
Figure 4:
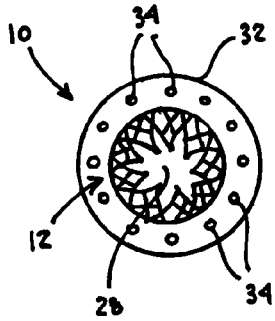
FIG. 4 is a top view of the material separation device of FIG. 2.

In one preferred and non-limiting embodiment, the body 14 of the separator member 12 is in the form of a cone 22. This cone 22 includes a tip area 24 and a base area 26. In this embodiment, the material exit portion 18 of the separator member 12 is located at the base area 26 of the cone 22. Such an arrangement is illustrated in FIGS. 2-4. Further, the material exit portion 18 is substantially the width of the internal area 102 of the material transfer pipe 104. This ensures that the clumps 202 of material 200 contact some portion of the body 14 of the separator member 12, which serves to separate the material 200. Accordingly, no clumps 202 are allowed to pass around the material separation device 10 without contacting it.

As best seen in FIG. 4, in this embodiment, the body 14 includes a material entry portion 28. This material entry portion 28 is positioned at the tip area 24 of the cone 22. The use of this material entry portion 28 serves to allow for better flow characteristics of the material 200 through the internal area 102 of the material transfer pipe 104. In addition, the use of such material entry portion 28 prevents any additional clumping, collection or blockage as the material 200 flows through the material transfer pipe 104 and contacts the tip area 24 of the cone 22.

As seen in FIG. 7, the tip area 24 of the cone 22 extends within the internal area 102 of the material transfer pipe 104. Furthermore, this tip area 24 extends within and towards the first, upstream section 110 of the material transfer pipe 104. Therefore, the body 14 of the separator member 12 does not act as a concave or "catch" area, which would hinder flow and lead to additional clumping and blockage. Instead, the orientation of the cone 22 with the tip area 24 towards the first, upstream section 110 of the material transfer pipe 104 allows the material 200 and clumps 202 of material 200 to impact a substantially convex or "edged" member.

As best seen in FIGS. 2 and 7, the material passageways 16 can be in a variety of forms and shapes. For example, the material passageway 16 can be in the form of diamonds, squares, circles, polygons, etc. However, in the preferred embodiment, the material passageways 16 are in the form of diamonds, which maximize the contact points between the clumps 202 of material 200 and the body 14 of the separator member 12.

The separator member 12 can be manufactured from a variety of materials. For example, in one preferred and non-limiting embodiment, the body 14 of the separator member 12 is manufactured from a raised, expanded metallic material. This raised, expanded metallic material provides the material passageways 16 in the form of diamonds, which are formed during the manufacture of this material. In addition, this metallic material can be a metal, a semi-metal, an alloy, carbon steel, stainless steel, aluminum, etc.

Figure 5:
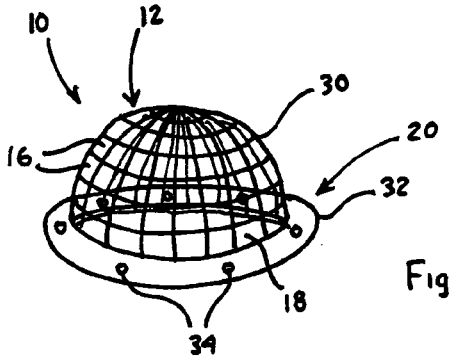
FIG. 5 is a perspective view of another preferred embodiment of a material separation device according to the present invention.

While one preferred embodiment is the cone 22 discussed above, any shape of the body 14 and separator member 12 is envisioned. In particular, a variety of shapes can be used to obtain different separation characteristics, as well as different flow characteristics. For example, as shown in FIG. 5, the body 14 of separator member 12 can be in the form of a dome 30. In addition, this dome 30 includes material passageways 16 that are substantially square-shaped. In this embodiment, the dome 30 does not include a material entry portion 28. Accordingly, as with the shape of the body 14, the material passageways 16 can be a variety of shapes and sizes in order to maximize the separation characteristics with respect to the material 200. As is known in the art, different material 200 acts in different ways and sticks or clumps together yielding different characteristics and flow properties. Therefore, the shape and size of the material passageways 16 can be optimized in order to maximize the separation characteristics of the material separation device 10.

As seen in FIG. 6, the attachment mechanism 20 can be a flange 32. The body 14 of the separator member 12 is attached to the flange 32 by a variety of methods, as is known in the art. For example, the body 14 can be welded to the flange 32, for example, at the base area 26 thereof. In addition, the flange 32 can include multiple and spaced apertures 34 for use in connecting the material separation device 10 within the material handling system 100 and to the material transfer pipe 104 or vessel 122. For example, these spaced apertures 34 can be shaped to accept an attaching member 36, such as a bolt, a nut arrangement, a screw, etc.

In one embodiment, where the material exit portion 18 is positioned at a bottom edge 38 of the body 14, it is this bottom edge 38 of the body 14 that is securely attached to the flange 32. In particular, in this embodiment, the flange 32 is a substantially circular structure with a centrally positioned circular orifice 40 extending therethrough. As seen in FIG. 6, the circular orifice 40 defines an inner edge 42. Furthermore, an attachment rim 44 extends from and along at least a portion of the inner edge 42. Accordingly, the bottom edge 38 of the body 14 is attached to this attachment rim 44 of the flange 32. Such an arrangement maximizes the width of the material exit portion 18 and ensures that material does not block or stick at the base area 26 of the body 14.

As seen in FIGS. 1 and 7, and as best illustrated in FIG. 7, the material separation device 10 is attachable between the first, upstream section 110 of the material transfer pipe 104 and the second, downstream section 112 of the material transfer pipe 104. As is known in the art, the first, upstream section 110 of the material transfer pipe 104 includes a first flange 114 attached thereto, while the second, downstream section 112 of the material transfer pipe 104 includes a second flange 116 attached thereto. Both the first flange 114 and the second flange 116 include multiple and spaced apertures 118. At least some of these apertures 118 are alignable with the spaced apertures 34 of the flange 32 of the material separation device 10. The flange 32 of the material separation device 10 is sandwiched between the first flange 114 and the second flange 116.

As seen in FIG. 7, at least some of the apertures 118 of the first flange 114 and the second flange 116 are aligned with the apertures 34 of the flange 32 of the material separation device 10. Next, an attaching member 36, such as a bolt, is fed through the apertures 118, 34, thereby securing the flange 32 between the first flange 114 and the second flange 116. This, in turn, secures the separator member 12 within the internal area 102 of the material transfer pipe 104. This allows for the easy maintenance of the material separation device 10 through the easy attachment and dismantling structures, which are in the form of flanges 114, 116, 32. The use of such flanges 114, 116, 32 is well known in the art and provides a simple, yet secure attachment mechanism 20.

In manufacturing the material separation device 10 of the present invention, and in one preferred and non-limiting embodiment, the separator member 12 is formed from a substantially planar body, which already includes a material passageway 16 extending therethrough. The body 14 is manipulated into the form of the cone 22, dome 30 or other similar shape, which includes a base area 26 having a material exit portion 18 positioned at a bottom edge 38 thereof. In addition, a tip area 24 is provided, and this tip area 24 may or may not have the material entry portion 28. Next, the base area 26, such as the bottom edge 38, is attached to the attachment mechanism 20, such as the flange 32.

In forming the starting stock of the body 14 and the separator member 12, a sheet of a metallic material could be slitted. Next, this slitted sheet is stretched in a die to form the material passageways 16 discussed above. In this process, the material passageways 16 are in the form of a raised, diamond pattern. However, as discussed above, a variety of patterns are envisioned.

Figure 8:
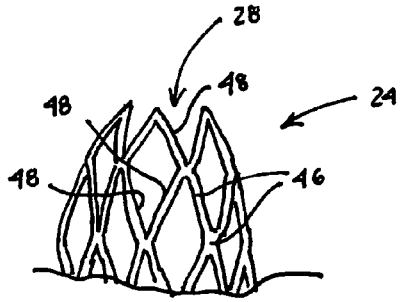
FIG. 8 is a side view of one embodiment of a tip area of a material separation device according to the present invention.
Figure 9:
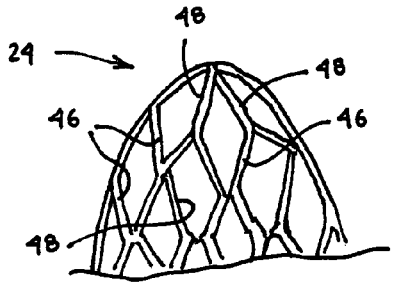
FIG. 9 is a side view of another embodiment of a tip area of a material separation device according to the present invention.
Figure 10:
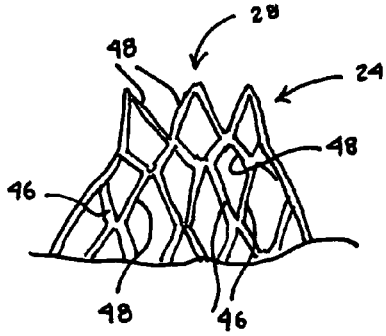
FIG. 10 is a side view of a further embodiment of a tip area of a material separation device according to the present invention.

In the forming process, the tip area 24 of, for example, the cone 22, may or may not include the material entry portion 28. As seen in FIG. 8, a material entry portion 28 is provided, and this material entry portion 28 provides additional projecting structure to assist in separating the clumps 202 of the material 200. In addition, the use of the diamond pattern illustrated in FIGS. 8-10 provides material passageways 16 bounded by segments 46 having sharp edges 48. These sharp edges 48 also provide additional separation characteristics when the clumps 202 of material 200 impact them.

As shown in FIG. 9, a material entry portion 28 is not required and, if appropriately formed, does not provide an area that will serve to collect the clumps 202 of material 200, or allow the pocketing and subsequent clumping of particles 204. Furthermore, as seen in FIG. 10, the tip area 24 of the body 14 can be bent such that the tip area 24 and edges 48 of the segments 46 at the tip area 24 are aligned directly against the flow of the material 200 within the internal area 102 of the material transfer pipe 104. Again, such an arrangement maximizes separation of the clumps 202 of material 200, without inhibiting the flow of the material 200 through the material transfer pipe 104. Accordingly, and again, the shape, size and arrangement of the body 14 and material passageway 16 can be optimized to achieve the desired flow characteristics and separation function.

While discussed above in connection with a first, upstream section 110 and second, downstream section 112 of a material transfer pipe 104, it is also envisioned that the material separation device 10 can be attached near an entryway 120 of a collection vessel 122, or an exit 124 of the vessel 122. In particular, the attachment mechanism 20 of the material separation device 10 would be connected between the entryway 120 and the material transfer pipe 104, with a separator member 12 still extending within the material transfer pipe 104. Further, as seen in FIG. 11, the attachment mechanism 20 of the material separation device 10 could be connected between the exit 124 and the material transfer pipe 104, with the separator member 12 extending within an internal area of the vessel 122. These arrangements would be useful in breaking apart the clumps 202 of material 200 into particles 204 immediately prior to loading or unloading the collection vessel 122. A number of such arrangements are envisioned, such as using the material separation device 10 in connection with vehicles, loading systems, material handling systems and the like.

The present invention is suitable for use in connection with a variety of materials 200 that require separation. For example, while the material separation device 10 can be used in connection with any powdered, granular or small particle material 200, the material separation device 10 is particularly useful in connection with food products, such as flour, sugar, rice, grain, starch, cornmeal, etc. In addition, the flange 32 can be manufactured in any diameter to suit the material handling system 100. For example, in the food industry, 5-inch, 5.5-inch and 6-inch flanges are typically used, however, smaller or larger flanges 32 can be manufactured and the separator member 12 be fitted accordingly. In addition, any suitable attachment mechanism 20 is envisioned for securely attaching the separator member 12 within the internal area 102 of the material transfer pipe 104 or any suitable component (such as the vessel 122) of the material handling system 100.

In this manner, the present invention provides a material separation device 10 and method for separating material 200 that is usable within a material handling system 100 and within an existing material transfer pipe 104 or vessel 122. The material separation device 10 is retrofittable within an existing transfer pipeline or vessel. Still further, the material separation device 10 and method represents a simple structure and process that relies on the flow of material 200 through the material transfer pipe 104 or vessel 122 (and impact with the separator member 12) to effectively separate and break apart clumps 202 of material 200.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A material separation device for use in an internal area of a material handling system for handling a material, the separation device comprising:

a separator member having:

(i) a body having a tip area, a base area and a plurality of material passageways extending therethrough, wherein the tip area is configured for arrangement such that it extends toward an upstream portion in the internal area of the material handling system;

(ii) a material entry portion, wherein the material initially contacts the separator member at the material entry portion;

(iii) a material exit portion located substantially at the base area, wherein the material exits the separator member at the base area; and an attachment mechanism configured to securely attach the separator member within the internal area of the material handling system;

wherein the body further comprises a plurality of segments at least partially bounding the plurality of material passageways, at least one of the plurality of segments having a sharp edge configured to contact and separate the material contacted therewith.

2. The device of claim 1, wherein the body is substantially in the form of a cone or a dome.

3. The device of claim 1, wherein the width of the material exit portion is substantially the width of an internal area of a material transfer pipe in the material handling system.

4. The device of claim 1, wherein the tip area of the body extends within an internal area of a material transfer pipe in the material handling system.

5. The device of claim 1, wherein the plurality of material passageways are in the form of diamonds, squares, circles, polygons or any combination thereof.

6. The device of claim 1, wherein the body is manufactured from a raised, expanded metallic material.

7. The device of claim 6, wherein the plurality of material passageways are substantially in the form of diamonds, which are formed during the manufacture of the raised, expanded metallic material.

8. The device of claim 6, wherein the metallic material is a metal, a semi-metal, an alloy, carbon steel, stainless steel, aluminum or any combination thereof.

9. The device of claim 1, wherein the attachment mechanism is a flange, the body of the separator member is attached to the flange, and wherein the flange includes a plurality of spaced apertures through which an attaching member is insertable.

10. The device of claim 9, wherein the body is substantially in the form of a cone or a dome, with the material exit portion positioned at a bottom edge of a base area thereof, and wherein the bottom edge of the body is securely attached to the flange.

11. The device of claim 10, wherein the flange is substantially circular with a centrally positioned circular orifice extending therethrough and defined by an inner edge, wherein an attachment rim extends along at least a portion of the inner edge, the bottom edge of the body attached to at least a portion of the attachment rim.

12. The device of claim 9, wherein the material separation device is positioned in an internal area of a material transfer pipe in the material handling system, and wherein the flange is positionable and attachable between a first flange attached to a first section of the material transfer pipe and a second flange attached to a second section of pipe, wherein the first flange and the second flange include a plurality of spaced apertures, at least some of which are alignable with the spaced apertures of the flange of the attachment mechanism.

13. The device of claim 9, wherein the material separation device is positioned in an internal area of a vessel in the material handling system, and wherein the flange is positionable and attachable between a first flange attached to a first section of a material transfer pipe and a second flange attached to the vessel; wherein the first flange and the second flange include a plurality of spaced apertures, at least some of which are alignable with the spaced apertures of the flange of the attachment mechanism.

14. A method of manufacturing a material separation device, comprising:

(a) forming a separator member having a substantially planar body with a plurality of passageways extending therethrough, the body including a plurality of segments at least partially bounding the plurality of passageways, at least one of the plurality of segments having a sharp edge configured to contact and separate a material contacted therewith;

(b) manipulating the body substantially into the form of a cone or a dome having: (i) a base area with a material exit portion positioned at a bottom edge thereof and (ii) a tip area with a material entry portion; and (c) attaching the base area of the body to an attachment mechanism:

wherein body is configured for arrangement, such that the tip area extends toward an upstream portion in an internal area of a material handling system, the material initially contacts the separator member at the material entry portion, and the material exits the separator member at the base area.

15. The method of claim 14, wherein the forming step comprises the steps of:

slitting a sheet of a metallic material; and stretching the sheet in a die to thereby form the plurality of passageways in a raised diamond pattern.

16. The method of claim 14, wherein the attachment mechanism is a flange, the bottom edge of the body securely attached to the flange.

17. The method of claim 14, wherein the attaching step includes welding, brazing, adhering, joining, fixing, stamping or any combination thereof.

18. A method of separating a material flowing through a material handling system, comprising:

attaching a separation device between a first, upstream portion of the material handling system and a second, downstream portion of the material handling system, the separation device including a separator member having: (i) a body with a plurality of material passageways extending therethrough; and (ii) a material exit portion, wherein the body projects within and towards the first, upstream portion of the material handling system and wherein the body further comprises a plurality of segments at least partially bounding the plurality of material passageways, at least one of the plurality of segments having a sharp edge configured to contact and separate the material contacted therewith; and contacting the material flowing through the first, upstream portion of the material handling system with the body of the separation device, thereby separating any clumped material flowing through the material handling system, the separated material thereby flowing through the material exit portion of the body and into the second, downstream portion of the material handling system.

19. The method of claim 18, wherein the material is a powdered material, a granular material, a food product, flour, rice, sugar, cornmeal, starch, cement or any combination thereof.

* * * * *